United States Patent [19]

Gal

[11] 4,335,643

[45] Jun. 22, 1982

[54] SEMI-AUTOMATIC FIREARMS

[75] Inventor: Uzi Gal, Philadelphia, Pa.

[73] Assignee: Action Manufacturing Company, Philadelphia, Pa.

[21] Appl. No.: 150,681

[22] Filed: May 16, 1980

[51] Int. Cl.[3] ..... F41C 5/06

[52] U.S. Cl. ..... 89/196; 42/25; 89/198

[58] Field of Search ..... 89/194, 195, 196, 197, 89/198; 42/16, 18, 69 A, 25

[56] References Cited

U.S. PATENT DOCUMENTS

| | | | |
|---|---|---|---|
| 356,274 | 1/1887 | Diss | 42/16 |
| 513,237 | 1/1894 | Kimball | 42/18 |
| 900,865 | 10/1908 | Louis | 89/196 |
| 984,489 | 2/1911 | Redfield | 89/194 |
| 2,365,188 | 12/1944 | Gorton | 89/198 |

FOREIGN PATENT DOCUMENTS

| | | | |
|---|---|---|---|
| 758917 | 1/1934 | France | 89/197 |

*Primary Examiner*—Stephen C. Bentley
*Attorney, Agent, or Firm*—Fleit & Jacobson

[57] ABSTRACT

Disclosed is a semi-automatic firearm which has a configuration generally similar to a known form of submachine gun insofar as it comprises an elongate receiver, a pistol grip extending downwardly from the receiver and forming a housing for a cartridge magazine and a trigger mechanism and sear located forwardly of the pistol grip. The firearm operates on the blowback principle with closed breech type operation and employs a slidable bolt and separate slidable firing pin striker mechanism within the receiver, with the bolt being freely slidable and the sear operating on the striker mechanism. The trigger mechanism only has a semi-automatic and a safety setting and the bolt face has a feed lip of a design which causes the firearm intentionally to jam under certain abnormal operating conditions.

13 Claims, 10 Drawing Figures

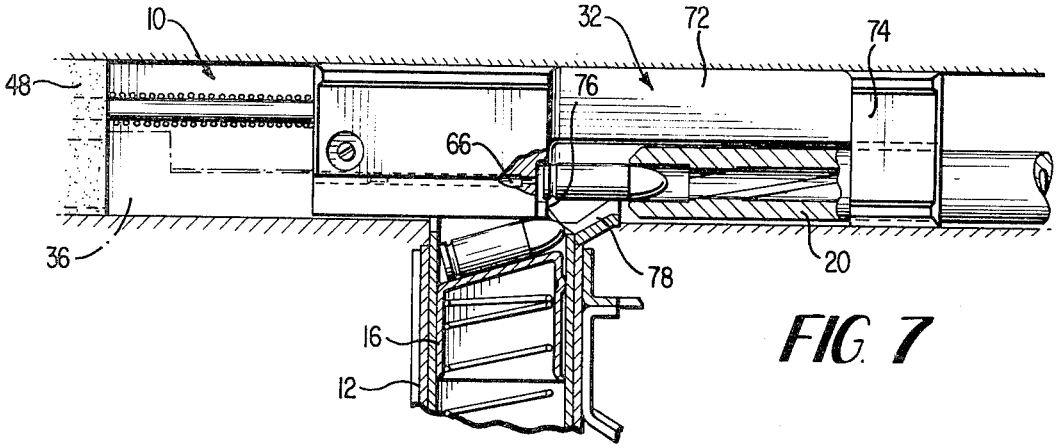
FIG. 7
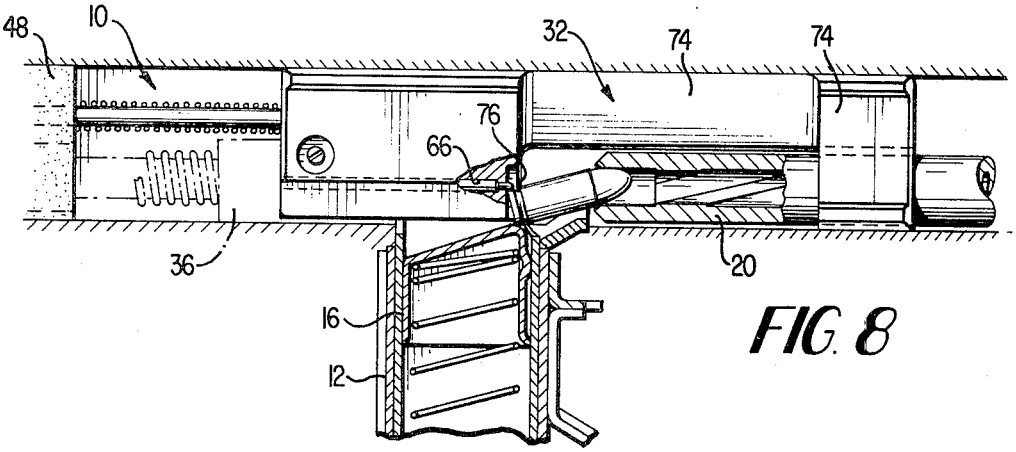
FIG. 8
FIG. 4
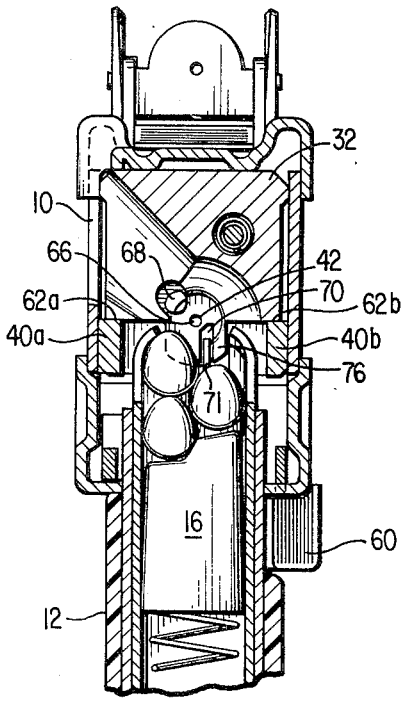

SEMI-AUTOMATIC FIREARMS

BACKGROUND OF THE INVENTION

This invention relates to hand-held semi-automatic firearms, namely firearms which automatically extract a spent cartridge from a firing chamber after a shot is fired, eject the cartridge, cock the firing mechanism and present a fresh cartridge to the chamber for a subsequent shot, but which require separate manual trigger operations to effect the actual firing or each individual shot. Such firearms are contrasted from firearms having a fully automatic capability by which a single and continued depression of the trigger is effective to fire repeated shots until the trigger is released.

One object of the invention is to provide a semi-automatic firearm having a unique firing mechanism design and configuration.

Another object of the invention is to provide a semi-automatic firearm which cannot readily be converted to fully automatic action.

A further object of the invention is to provide a novel form of semi-automatic firearm working on the blowback principle with closed breech operation.

A still further object of the invention is to provide a semi-automatic firearm having an overall configuration similar to that of a conventional submachine gun.

SUMMARY OF THE INVENTION

A semi-automatic firearm is provided which has the general configuration of a known form of submachine gun insofar as a pistol grip extends downwardly from a receiver and forms a housing for a magazine or clip, and the trigger mechanism is positioned immediately in front of the pistol grip, with the sear also being located to operate forwardly of the grip and magazine. The firearm operates on the blowback principle and the trigger mechanism has a setting for semi-automatic firing only and a locked safety setting. The trigger mechanism can take any convenient known form which employs a disconnector between the trigger and sear to limit the weapon to single shot operation in the semi-automatic mode. The firearm's firing mechanism comprises a sliding breech block or bolt, a floating firing pin and a striker mechanism for the firing pin. The firing pin can be integral with or separated from the striker mechanism. The striker mechanism is in the form of a longitudinally extending slide arrangement which fits in the bottom of the receiver. It has sear-engaging surfaces at its forward end and at the rear has an upwardly extending shoulder forming a striker structure. The bolt fits on top of the slide and the slide and bolt have separate recoil springs acting against or in a common buffer block at the back of the receiver.

When the bolt moves back, during manual cocking of the weapon, or on blowback after a shot is fired, engagement of the bolt with the striker mechanism shoulder also causes the striker mechanism to be drawn back in concert. On completion of the rearward movement, the bolt is free to move forward to feed a cartridge into the firing chamber, but the striker mechanism is held back by engagement of the sear with the forward end of the slide. Thus, closed breech operation is effected and when the trigger is depressed, the slide is released, allowing forward motion of the striker mechanism to fire a single shot.

In its forward movement, the bolt feeds a cartridge from the magazine, over a feed ramp, into the firing chamber and in this operation, the bolt face engages the base of the cartridge to press it out of the magazine. In the present firearm, the bolt face has a unique design insofaras it is provided with a forwardly projecting rim or feed lip which extends only partially around the bolt face itself. The feed lip is asymetrical disposed in relation to the longitudinal center line of the firearm and only extends around the bolt face on one side of the center line. The purpose of this asymetrical feed lip is to cause the firearm intentionally to jam after a maximum of a single shot is fired, should conditions for any reaon arise in which the firing pin projects from the bolt face during forward motion of the bolt. In normal operation, the firing pin is held behind the bolt face during forward motion of the bolt and in these conditions the asymetrical feed lip does not cause the firearm to jam.

The above described feature enable a firearm to be produced which has the appearance and general configuration of a conventional submachine gun but which can effectively only be fired in a semi-automatic mode.

BRIEF DESCRIPTION OF THE DRAWINGS

FIG. 4 is a section on line IV—IV of FIG. 3;

FIG. 7 is a sectional side view of a part of the firearm illustrating how a cartridge is fed into the firing chamber during normal operation of the firearm;

FIG. 8 is a view similar to FIG. 7 but showing how a cartridge would tend to jam in the breech under abnormal operating conditions;

DESCRIPTION OF PREFERRED EMBODIMENT

Figure 1:
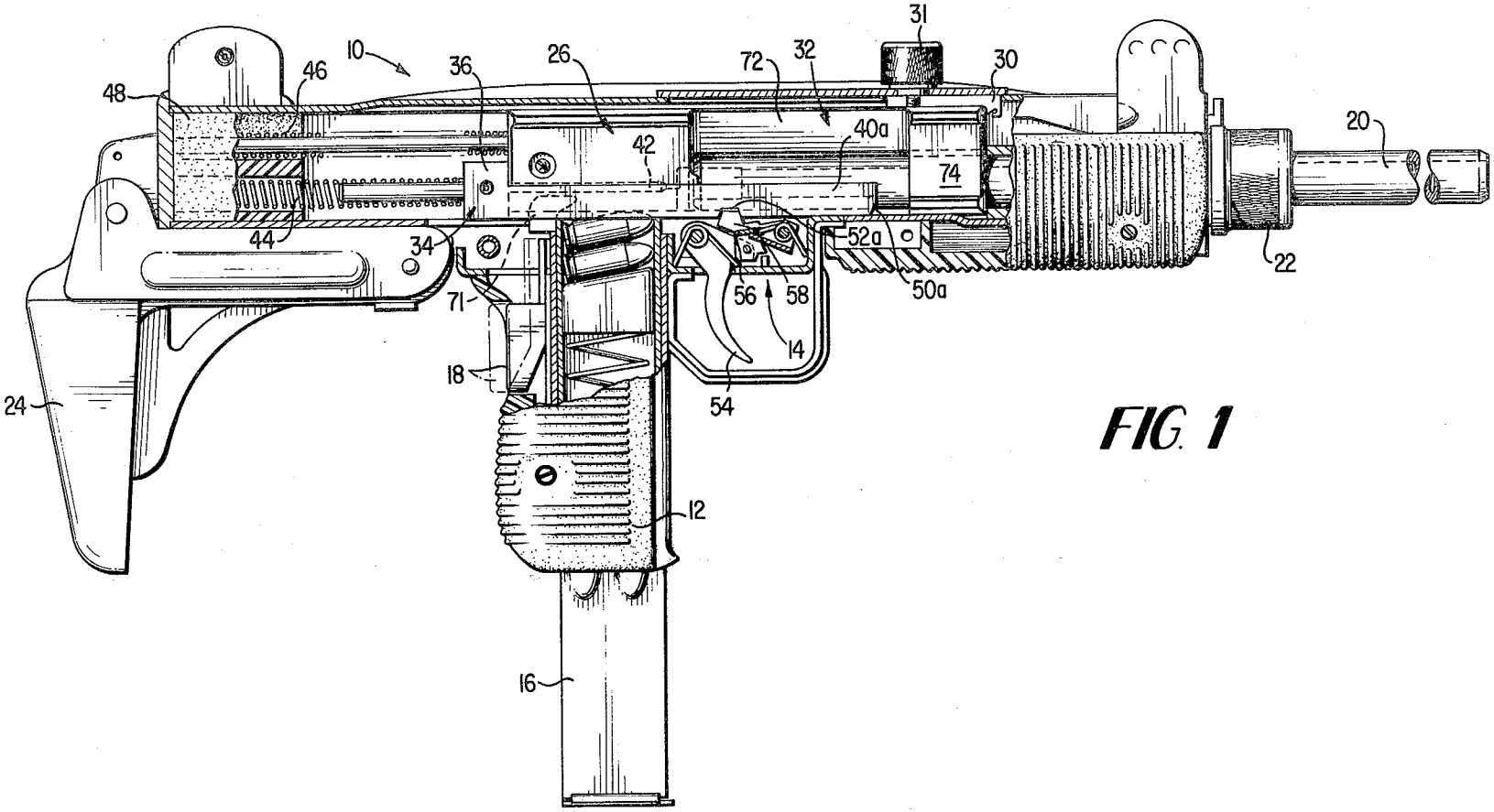
FIG. 1 is a side elevation partly broken away, of a semi-automatic firearm in the uncocked condition.

As shown more particularly in FIGS. 1 to 4, the illustrated firearm has the overall configuration of a known form of submachine gun, the general features of which will be well known and readily apparent to persons skilled in the art and which will not therefore be described herein in detail. Thus, the weapon has an elongate receiver 10, a pistol grip 12 extending downwardly from the receiver and forming a housing for a conventional cartridge magazine or clip 16, a trigger mechanism 14 forwardly of the pistol grip, a grip safety 18, barrel 20 mounted in the receiver with a firing chamber at its rearward end, an extensible and retractable stock 24, a firing mechanism generally indicated at 26 and a manual cocking knob 31.

The invention is concerned more particularly with the arrangement of the firing mechanism 26 and this mechanism will be described in detail along with its interrelationship with the remaining parts of the firearm.

The firing mechanism 26 consists essentially of a sliding breech block or bolt 32, shown in detail in FIG.

Figure 6:
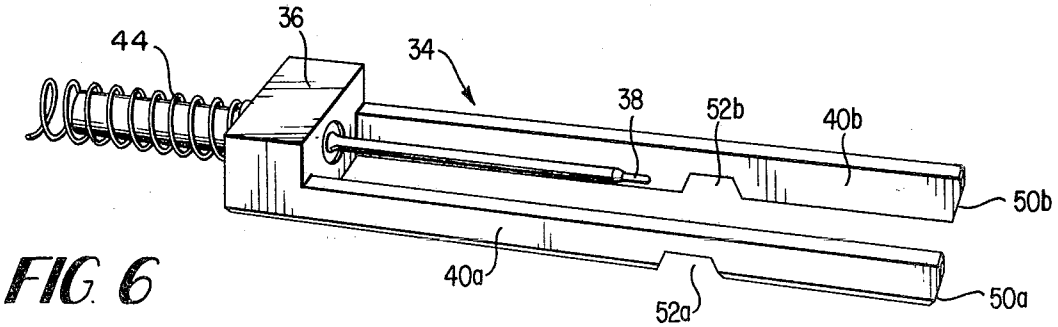
FIG. 6 is a perspective view from above of a striker mechanism.

5 and a striker mechanism 34, shown in detail in FIG. 6. The striker mechanism has a shoulder forming a striker structure 36 at its rearward end with an attached firing pin 38 and forwardly extending limbs 40*a* and 40*b* constituting a slide which sits on the base of the receiver, with the bolt 32 fitting over and between the limbs 40*a* and 40*b* and with the firing pin floating in a central firing pin passage 42 in the bolt. At its rear end, the striker mechanism has a mounting for a return spring 44 and a separate return spring 46 is provided for the bolt. Return springs 44 and 46 both seat in a buffer block 48 located at the rear end of receiver 10.

The forward ends 50*a* and 50*b* of slide limbs 40*a* and 40*b* are formed as abutment surfaces against which the sear arrangement of the trigger mechanism operates and limbs 40*a* and 40*b* are further provided with notches 52*a* and 52*b* which clear the sear arrangement (comprising twin sears 58) when the slide is in its forward position.

As indicated, the trigger mechanism can take any known form but which provides only a safety setting and a semi-automatic setting. In the safety setting the trigger mechanism is itself locked while in the semi-automatic setting, the trigger retracts the sear arrangement through a disconnector. The disconnector causes the sears to return to their firing mechanism-arresting position immediately after the sears have been retracted by depression of the trigger, so that for each depression of the trigger only a single shot can be fired. The illustrated trigger mechanism is of a well known type and comprises a trigger 54, disconnector 56 and the twin sears 58 (only one of which is shown) which, in known manner, are biased upwardly and project into the receiver in the paths of movement of the respective limbs 40*a* and 40*b*. Additionally, the grip safety 18 works in conjunction with the trigger mechanism in known manner so that in the semi-automatic setting, the trigger can only be operated when the grip safety is depressed. A setting knob 60 for the trigger mechanism is provided for adjusting the mechanism between the safe and semi-automatic settings. In the semi-automatic setting, when grip safety 18 is depressed, the trigger can be operated and when depressed serves to retract the sears momentarily from within the path of the firing mechanism, whereupon the disconnector 56 disconnects the sears from the trigger so that the sears under spring bias return to within the path of the firing mechanism. The construction of a suitable such trigger mechanism and grip safety is conventional and need not be described more fully herein.

Figure 5:
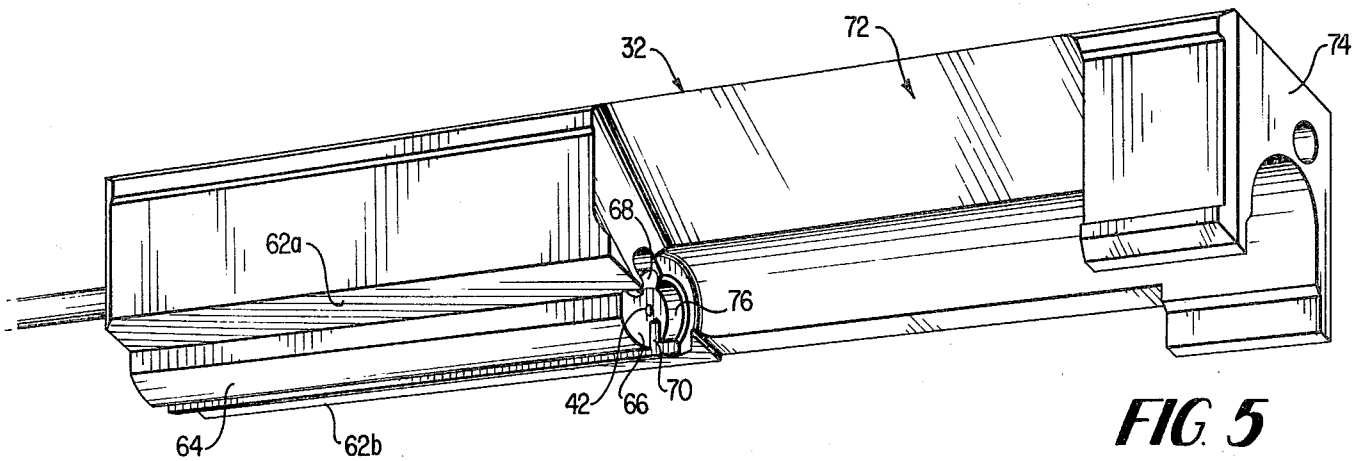
FIG. 5 is a perspective view from below of a breech block or bolt.

The breech block or bolt 32 of the instant invention is of a unique character insofar as at the rear end it has opposed undersurfaces 62*a* and 62*b* which slide on limbs 40*a* and 40*b*, respectively, and a central section 64 which fits between the limbs and which terminates at its forward end in a bolt face 66 (see FIG. 5). Central section 64 is provided on its axial center line with the firing pin passage 42 and also carries a conventional form of extractor 68. A lower axially extending slit 70 is provided in central section 64 for passage over a conventional form of ejector 71 on the base of receiver 10. Forwardly of central section 64, the bolt has a breech opening 72 for expulsion of spent cartridge cases and a forward arched section 74, which can slide over the rearward end of barrel 20 and the opposed undersurfaces of which slide directly on the base of receiver 10.

As best shown in FIGS. 4 and 7, bolt face 66 is partly surrounded by a forwardly projecting feed lip 76, which extends only around the right hand side of the bolt face (the left hand side of the bolt face in accepted firearm terminology) while the opposite side of the bolt face is machined flush. The purpose of the feed lip only partly surrounding the bolt face will be described below.

Operation of the firearm is as follows:

With a magazine or clip inserted into the pistol grip housing and the trigger mechanism in its semi-automatic setting, the firearm is manually cocked by pulling back on the cocking knob 31 from the position shown in FIG. 1. This operation draws bolt 32 back against return spring 46 and striker mechanism 34 is drawn back along with the bolt against spring 44, by engagement of the bolt with the upstanding shoulder forming the striker structure. Sears 58 are resiliently depressed by limbs 40*a* and 40*b* during the cocking action and when limbs 40*a* and 40*b* reach the rearward position shown in FIG. 3, the sears snap back up into position against the forward edges of limbs 40*a* and 40*b* to arrest forward travel of the striker mechanism. On release of the cocking knob, the bolt 32 is free to move forwardly from its rearward position, under the action of spring 46, and this causes the bolt face 66 to engage the topmost cartridge in the magazine and propel this cartridge forwardly into the firing chamber over a feed ramp 78 shown in FIG. 7. If the topmost cartridge of the magazine happens to be on the right hand side (as viewed in FIG. 4), the cartridge will initially be engaged by the lower end of the partial feed lip 76 (FIG. 5). Then, the cartridge centers itself as it enters the firing chamber and its base comes to rest directly against the bolt face 66. If, on the other hand, the topmost cartridge is on the left of the magazine as viewed in FIG. 4, then the cartridge will be engaged by the bolt face itself and the cartridge base will slide directly up the bolt face to center itself as the cartridge enters the firing chamber. (It is to be noted that the firing pin is being held back in the withdrawn position during forward movement of the bolt so that the firing pin tip does not protrude forwardly from the bolt face).

Figure 2:
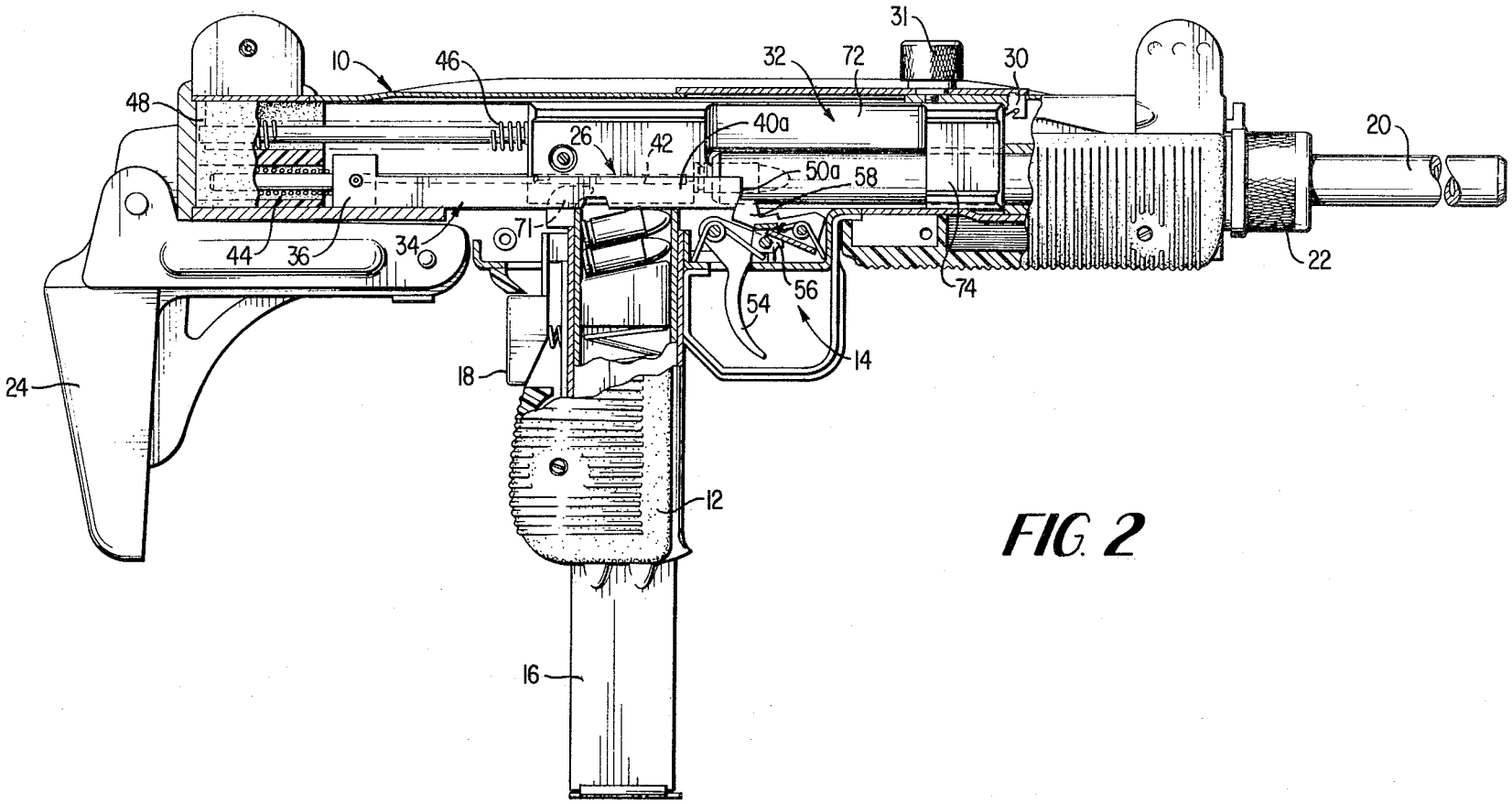
FIG. 2 is a view similar to FIG. 1 but with the firearm in the cocked condition.
Figure 3:
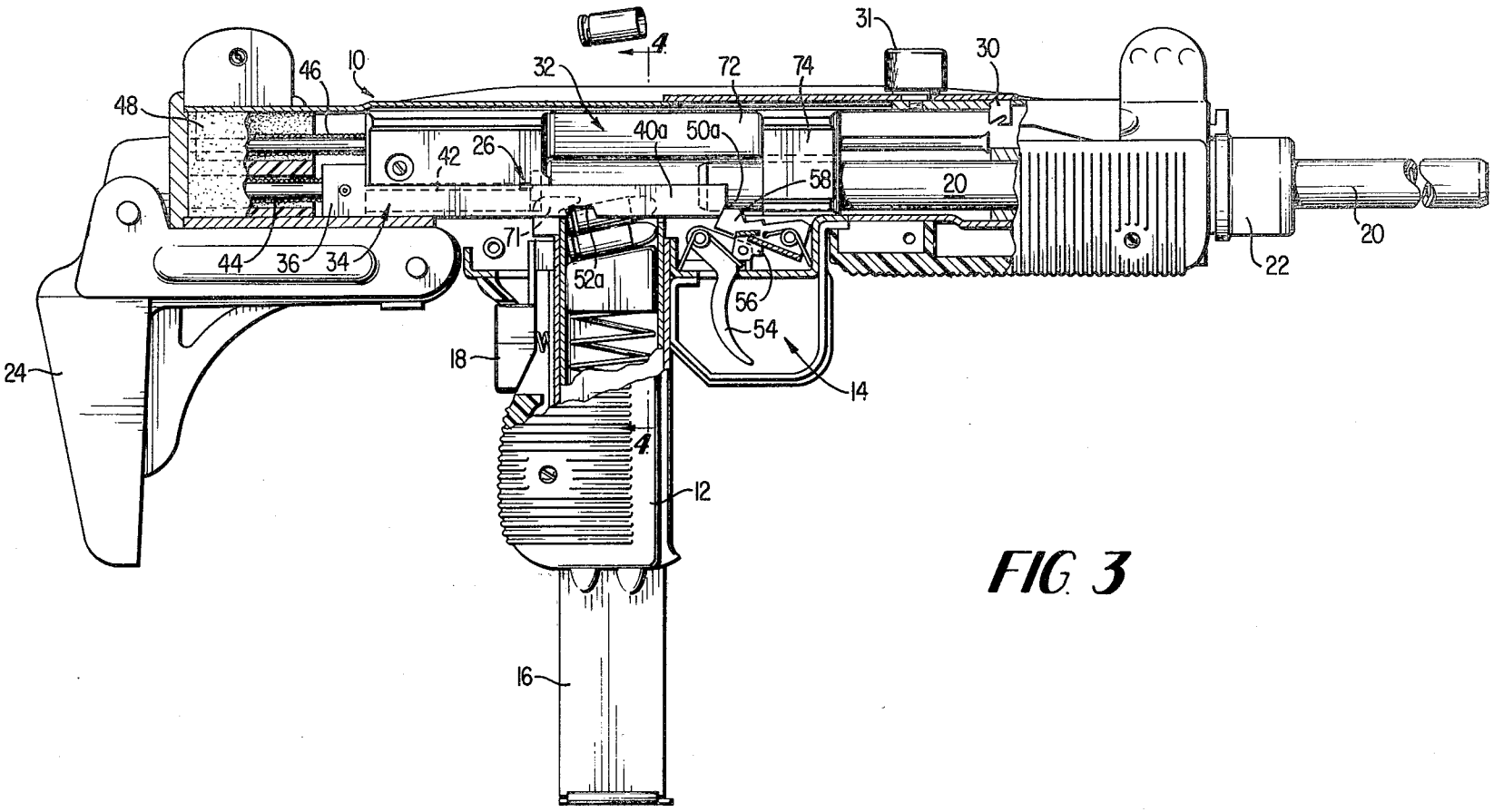
FIG. 3 is a view similar to FIGS. 1 and 2 but showing the bolt in its extreme rear position after a shot has been fired.

The bolt has now moved fully forward, fed a cartridge into the chamber and the firearm is in the FIG. 2 condition ready for firing (closed breech operation).

Then, to fire a shot, the grip safety and trigger are depressed and this action momentarily withdraws sears 58 from engagement with the forward ends of limbs 40*a* and 40*b* allowing the striker mechanism to move forward under the action of spring 44. The firing pin strikes the cartridge previously fed into the firing chamber and the shot is fired. Blowback of the bolt 32 then takes place in the usual way, this being accompanied by withdrawal of the spent case from the firing chamber by the extractor 68 and ejection of the cartridge by ejector 71 through the bolt opening 72 and a registering opening in the side of the receiver. Sears 58 have meanwhile been released by the trigger mechanism disconnector and are spring biased back into the paths of travel of limbs 40*a* and 40*b*. The blowback action of the bolt has a similar effect to the previously described manual cocking action, whereby the striker mechanism is drawn back in conjunction with the bolt until sears 58 again engage the front faces of limbs 40*a* and 40*b* and the firing mechanism moves back to the position shown in FIG. 3. The bolt however, is again free to move forward under the action of spring 46 and feed the succeeding cartridge (irrespective of whether this comes from the left or right hand side of the magazine) into the firing chamber. The system is thus returned to the FIG. 2 condition and is ready for the next shot, once the trigger has been released.

As previously indicated, the feed lip 76 which only partly surrounds the bolt face, serves the purpose of intentionally causing the firearm to jam should conditions for any reason arise in which the firing pin moves with the bolt and therefore projects from the bolt face during forward movement of the bolt (i.e., akin to open breech operation with a fixed firing pin). In these conditions, if the topmost cartridge in the magazine is on the right as viewed in FIG. 4, (i.e., on the same side as the projecting lip) it will be engaged by the lip on forward travel of the bolt and will become correctly centered as it enters the firing chamber as previously described. If however the topmost cartridge in the magazine is on the left as viewed in FIG. 4, when the bolt moves forward, the base of the cartridge is engaged by the exposed bolt face itself and when the cartridge base moves up the bolt face as it approaches the firing chamber, in an effort to center itself, the base of the cartridge engages under the projecting firing pin. This effectively prevents proper centering of the cartridge and causes jamming of the cartridge in the breech as illustrated in FIG. 8, so that the cartridge cannot be chambered. Thus, if the bolt were to have the firing pin projecting from the bolt face during forward movement, the firearm could only fire a maximum of a single shot before jamming occurred.

Figure 9:
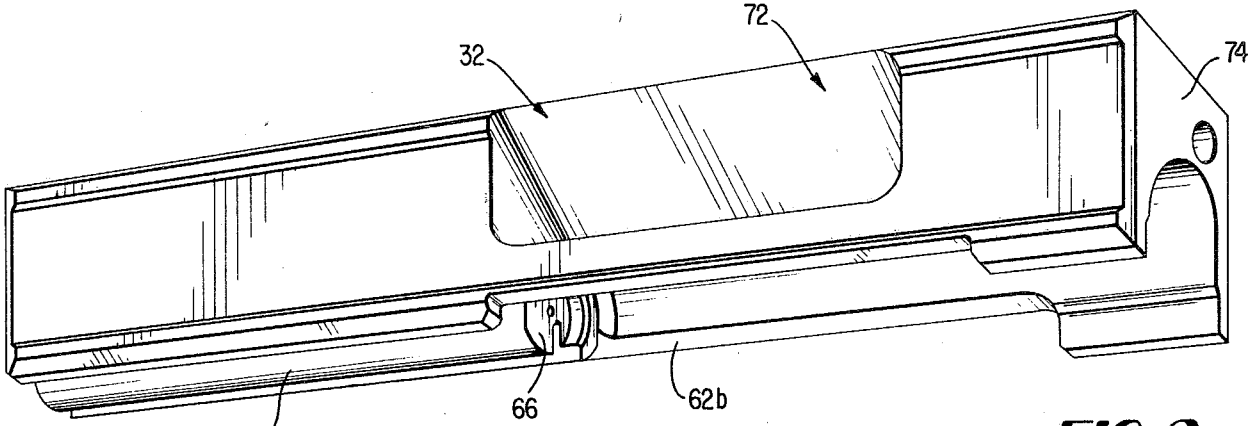
FIG. 9 is a perspective view from below of an alternative form of bolt.
Figure 10:
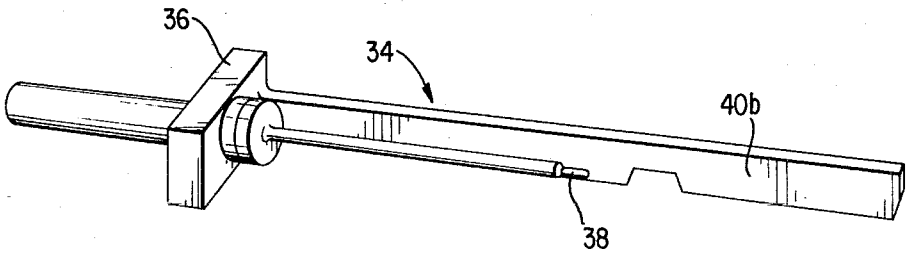
FIG. 10 is a perspective view from above of an alternative form of striker mechanism.

While only a single embodiment of the present invention has been described, it is to be understood that the invention is not limited to the specific features of this embodiment and modifications are possible within the scope of the attached claims. For example, the firearm need only employ a single sear 58 and the striker mechanism may only have a single limb **40*b* with the bolt being of suitable configuration to conform with the single limb as shown in FIGS. 9 and 10** where like reference are used to denote parts referred to in the previous figures. Further, the firing pin itself can be separated from the striker structure and numerous other modifications can also be made to the construction as described above.

I claim:

1. A bolt for use in the firing mechanism of a firearm, said bolt having a section defining a bolt face for feeding cartridges from cartridge supply means into a firearm firing chamber on forward movement of the bolt, said cartridge supply means supplying cartridges from left and right sides thereof, said section having a longitudinal axis and said bolt face being substantially perpendicular to said longitudinal axis, a firing pin passage in said section leading to said bolt face and being substantially coaxial with said longitudinal axis and said bolt having shoulder means projecting outwardly from a portion of the periphery of the bolt face for centering a cartridge in a firing position and for supporting a cartridge during removal from the firing position, a portion of the periphery of the bolt face adjacent one side of the cartridge supply means being planar with said bolt face so that a cartridge being fed from the one side of the cartridge supply means has its base in sliding contact with the bolt face during feeding whereby a firing pin projecting from said bolt face prevents sliding of the cartridge base into the firing position, whereas a cartridge being fed from the other side of the cartridge supply means having its base in sliding contact with the projecting shoulder means during feeding.

2. A bolt according to claim 1, further comprising an axially-extending slit formed in said bolt face adjacent one end of the projecting shoulder means, said slit being shaped for passage therethrough of a cartridge ejector.

3. A bolt according to claim 2, further comprising an extractor carried by said bolt, said extractor being positioned approximately diametrically opposite said slit.

4. A bolt according to claim 3, wherein said projecting shoulder means is rigid and integral with said section defining the bolt face.

5. A bolt according to claim 3 or 4, wherein said projecting shoulder means comprises a single projecting shoulder extending around the periphery of the bolt face between said slit and said extractor.

6. The bolt as defined in claim 1 wherein said section of the bolt defines a central section and the bolt further includes laterally spaced longitudinally extending undersurfaces on opposite sides of said central section, said central section extending to a level below the level of said undersurfaces.

7. A firearm comprising an elongate receiver having a forward end, a rear end and a base, a housing means for cartridge supply means communicating with said receiver, said cartridge supply means supplying cartridges in alternating sequence from left and right sides thereof, a trigger mechanism located forwardly of said housing means and including trigger and sear means, said sear means being in communication with said receiver at a location forwardly of said housing means, a barrel extending into said receiver from said forward end, said barrel having a rearward end defining a firing chamber, and a firing mechanism in said receiver for operation between said rearward end of said barrel and said rear end of said receiver, said firing mechanism comprising a sliding bolt having a bolt face for engaging and for feeding a cartridge and an axially extending striker pin passage leading to said bolt face, a striker mechanism having a firing pin received in said passage, said striker mechanism including elongate longitudinally-extending slide means having a forward end portion defining sear-engaging abutment surface means, said slide means being mounted for longitudinal sliding movement on said receiver base, and said sear means being located to operate in the path of movement of said abutment surface means, said bolt having a rear surface for engaging said striker mechanism during rearward movement of the bolt to draw said striker mechanism back in concert with the bolt, a first return means between said bolt and said rear end of said receiver, and a second return means between said striker mechanism and said rear end of said receiver, said bolt having shoulder means projecting outwardly from a portion of the periphery of the bolt face for centering a cartridge in a firing position and for supporting a cartridge during removal from the firing position, a portion of the periphery of the bolt face adjacent one side of the cartridge supply means being planar with said bolt face so that a cartridge being fed from the one side of the cartridge supply means has its base in sliding contact with the bolt face during feeding whereby a firing pin projecting from said bolt face prevents sliding of the cartridge base into the firing position, whereas a cartridge being fed from the other side of the cartridge supply means having its base in sliding contact with the projecting shoulder means during feeding.

8. The firearm as defined in claim 7 wherein said bolt and said slide means have complimentary interengaging bearing surfaces comprising an upper surface of said slide means and a lower surface of said bolt.

9. The firearm as defined in claim 7 wherein said slide means comprises a longitudinal limb and wherein said sear means includes a sear member operative in the path of movement of said limb.

10. The firearm as defined in claim 9 wherein said bolt and said limb have interengaging bearing surfaces comprising an upper surface of said limb and a longitudinally extending undersurface on one side of said bolt.

11. The firearm as defined in claim 7 wherein said slide means comprises a pair of spaced apart longitudinal limbs and wherein said sear means comprises a pair of laterally spaced sears operable in the paths of movement of the respective limbs.

12. The firearm as defined in claim 11 wherein said bolt and each of said limbs have interengaging bearing surfaces comprising an upper surface of each of said limbs and laterally spaced undersurfaces of said bolt and wherein said bolt includes a central section located between said limbs and defining said bolt face and striker pin passage.

13. The firearm as defined in claim 7 wherein said receiver includes a buffer means at the rear end thereof and said first and second return means comprise first and second return springs having end portions received in said buffer means.

* * * * *